US008756714B2

(12) United States Patent
Reimer

(10) Patent No.: US 8,756,714 B2
(45) Date of Patent: Jun. 24, 2014

(54) VENTILATED GARMENT

(76) Inventor: Milton D. Reimer, Sanford (CA)

( * ) Notice: Subject to any disclaimer, the term of this patent is extended or adjusted under 35 U.S.C. 154(b) by 1007 days.

(21) Appl. No.: 12/840,344

(22) Filed: Jul. 21, 2010

(65) Prior Publication Data

US 2012/0017346 A1 Jan. 26, 2012

(51) Int. Cl.
*A41D 13/00* (2006.01)

(52) U.S. Cl.
USPC ..... 2/85; 2/82; 2/81; 2/DIG. 1; 2/DIG. 5

(58) Field of Classification Search
USPC ..... 2/69, 81, 82, 85, 79, 87, 108, 96, 97, 2/93, 270, 243.1, DIG. 1, DIG. 5
See application file for complete search history.

(56) References Cited

U.S. PATENT DOCUMENTS

| | | | | |
|---|---|---|---|---|
| 3,228,821 | A * | 1/1966 | Trope | 428/136 |
| 4,569,874 | A * | 2/1986 | Kuznetz | 428/109 |
| 4,731,883 | A * | 3/1988 | Foster | 2/69 |
| 5,526,532 | A * | 6/1996 | Willard | 2/69 |
| 5,631,074 | A * | 5/1997 | Herlihy, Jr. | 442/35 |
| 5,704,064 | A * | 1/1998 | van der Sleesen | 2/69 |
| 5,752,277 | A * | 5/1998 | van der Sleesen | 2/69 |
| 5,845,336 | A | 12/1998 | Golde | |
| 6,085,353 | A * | 7/2000 | van der Sleesen | 2/69 |
| 6,263,510 | B1 | 7/2001 | Bay et al. | |
| 6,263,511 | B1 * | 7/2001 | Moretti | 2/97 |
| 6,442,760 | B2 * | 9/2002 | Moretti | 2/115 |
| 6,833,333 | B2 * | 12/2004 | Reisdorf et al. | 442/64 |
| 6,848,119 | B2 * | 2/2005 | Crye et al. | 2/247 |
| 6,868,557 | B1 * | 3/2005 | van der Sleesen | 2/93 |
| 6,918,140 | B1 * | 7/2005 | Cooper | 2/228 |
| 7,043,767 | B2 * | 5/2006 | Jaeger | 2/87 |
| 7,284,282 | B2 | 10/2007 | Bay | |
| 2003/0033656 | A1 * | 2/2003 | Jaeger | 2/69 |
| 2006/0041990 | A1 * | 3/2006 | Alesina et al. | 2/93 |
| 2006/0185053 | A1 * | 8/2006 | Wittmann et al. | 2/69 |
| 2006/0277653 | A1 * | 12/2006 | Okajima | 2/93 |
| 2008/0184454 | A1 | 8/2008 | Collier | |
| 2010/0242149 | A1 * | 9/2010 | Mickle et al. | 2/82 |
| 2012/0017346 | A1 * | 1/2012 | Reimer | 2/69 |
| 2013/0318678 | A1 * | 12/2013 | Poucher | 2/79 |

* cited by examiner

*Primary Examiner* — Gloria Hale
(74) *Attorney, Agent, or Firm* — Ryan W. Dupuis; Kyle R. Satterthwaite; Ade & Company Inc.

(57) ABSTRACT

A ventilated garment includes a shell layer worn by the user and an auxiliary layer attached to a portion of shell to define a ventilated portion of the garment. An exterior opening formed in the outermost layer of the garment includes a fastener controlling the open or closed state of the exterior opening. A drain opening is also formed in the outermost layer separate from the exterior opening adjacent the bottom of the ventilated portion. Ventilating openings are formed in the waterproof innermost layer. A mesh layer spans the ventilating portion between the ventilating openings and the exterior opening to trap snow/rain and drain the precipitation through the drain opening therebelow to the exterior of the garment. The mesh layer blocks passage of precipitation therethrough while allowing a ventilating flow of air therethrough.

20 Claims, 5 Drawing Sheets

VENTILATED GARMENT

FIELD OF THE INVENTION

The present invention relates to a garment including a ventilated area between ventilating openings in respective inner and outer layers of the garment in which moisture accumulated in the ventilated area is arranged to be drained externally of the garment through a drain opening while ventilating air is permitted to flow through the ventilated area between the ventilating openings in the inner and outer layers.

BACKGROUND

In various outdoor activities, it is known to provide outerwear which protects the wearer from the weather. Protecting the wearer from the weather however limits the breathability of the garment and accordingly it is known to provide various forms of ventilation to the garment as described in prior U.S. Pat. No. 7,284,282 by Bay; U.S. Pat. No. 6,085,353 by van der Sleesen; U.S. Pat. No. 5,845,336 by Golde; and U.S. Pat. No. 6,263,510 by Bay et al. In each instance, the ventilation requires a large portion of the garment to incorporate multiple layers for ventilation between the layers resulting in a costly construction simply for the purpose of ventilation. Furthermore, none of the prior art discloses suitable means for blocking moisture from precipitation in reaching the user when the vents are in an open position. Accordingly, the vents are only intended to be open when there is no precipitation, however, when precipitation is present the wearer is prevented from ventilating the garment without becoming wet.

US patent application 2008/0184454 by Collier discloses a further variation of a vented apparel in which ventilation openings in inner and outer layers are offset from one another which provides some resistance to moisture penetrating from the outer layer to the inner layer. Even if moisture is not directly transmitted through to the user however there is no means to prevent user contact with the inner layer once the inner layer becomes saturated with moisture so that the user would typically still become wet if the vent is in an open condition during precipitation.

SUMMARY OF THE INVENTION

According to one aspect of the invention there is provided a ventilated garment comprising:

a shell arranged to be worn about a portion of a body of a user;

an auxiliary layer attached about a periphery thereof to one of an inner surface or an outer surface of the shell so as to define a ventilated portion of the shell;

an exterior opening formed in an outermost one of the auxiliary layer and the ventilated portion of the shell;

a fastener associated with the exterior opening and being arranged to be operable between an open position in which the exterior opening is substantially unobstructed and a closed position in which the exterior opening is closed;

a drain opening formed in the outermost one of the auxiliary layer and the ventilated portion of the shell adjacent a lowermost portion of the periphery of the auxiliary layer;

at least one ventilating opening formed in an innermost one of the auxiliary layer and the ventilated portion of the shell such that a lowermost edge of said at least one ventilating opening is spaced above said lowermost portion of the periphery of the auxiliary layer;

a mesh layer supported between the ventilated portion of the shell and the auxiliary layer such that ventilating air can only reach said at least one ventilating opening from the exterior opening by passing through the mesh layer.

The use of a mesh layer between the auxiliary layer and the shell permits snow and the like to be trapped between the mesh layer and the outermost layer for subsequent draining through the drain opening also in the outermost layer. The use of an additional innermost layer spanning the inner side of the mesh layer assists in minimizing user contact with the mesh layer so that even when the mesh layer becomes saturated with moisture, the contact of the innermost layer with the user is minimized, thus minimizing the transfer of the moisture to the inner clothing layers of the user.

Preferably a bottom end of the periphery of the auxiliary layer is sloped downwardly towards the drain opening.

The drain opening may comprise a reinforced eyelet mounted in the outermost one of the auxiliary layer and the ventilated portion of the shell.

There may be provided a plurality of ventilating openings at spaced apart positions in the innermost one of the auxiliary layer and the ventilated portion of the shell.

The ventilating openings may be substantially aligned with the exterior opening such that the ventilating openings and the exterior opening overlap one another for more direct ventilation therethrough.

Alternatively, the ventilating openings may be offset from the exterior opening such that the ventilating openings and the exterior opening do not overlap one another to provide greater resistance to water penetration therethrough. In this instance, the ventilating opening may be above the exterior opening.

The innermost one of the auxiliary layer and the ventilated portion of the shell preferably comprises a panel of material such that the ventilating opening comprises a punched opening in the panel. In this manner, the panel surrounding the ventilating opening supports the ventilating opening to remain in a fully open condition.

Preferably the ventilating aperture is spaced above the lowermost portion of the periphery of the auxiliary layer.

Preferably the ventilating aperture occupies less than half of a total area of the panel of material forming the innermost one of the auxiliary layer and the ventilated portion of the shell.

When there is provided a plurality of ventilating openings at spaced apart positions from one another, preferably the mesh layer comprises a single mesh panel spanning the plurality of openings which is only secured about a peripheral edge of the mesh layer relative to the shell and the auxiliary layer.

Preferably the mesh layer comprises a mesh material having mesh openings which are arranged to prevent passage of snowflakes therethrough.

The mesh layer may include a hydrophobic coating thereon.

In one embodiment, the peripheral edge of the mesh layer is secured to the shell adjacent to the periphery of the auxiliary layer.

Alternatively, the peripheral edge of the mesh layer may be secured about a periphery of the exterior opening. In this instance, the mesh layer may comprise a mesh panel spanning an area which is greater than an area of the exterior opening in the open position such that the mesh panel defines a lower trough portion between the shell and the auxiliary layer below the exterior opening.

In a preferred embodiment, the auxiliary layer is attached to the inner surface of the shell such that the exterior opening and the drain opening are located in the ventilated portion of the shell and the ventilating openings are located in the auxiliary layer.

Alternatively, the auxiliary layer may be attached to the outer surface of the shell such that the exterior opening and the drawing opening are located in the auxiliary layer and the ventilating openings are located in the ventilated portion of the shell.

Preferably a strip of sealing material overlaps the periphery of the auxiliary layer so as to be in sealing engagement with both the shell and the auxiliary layer about a full perimeter of the auxiliary layer.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
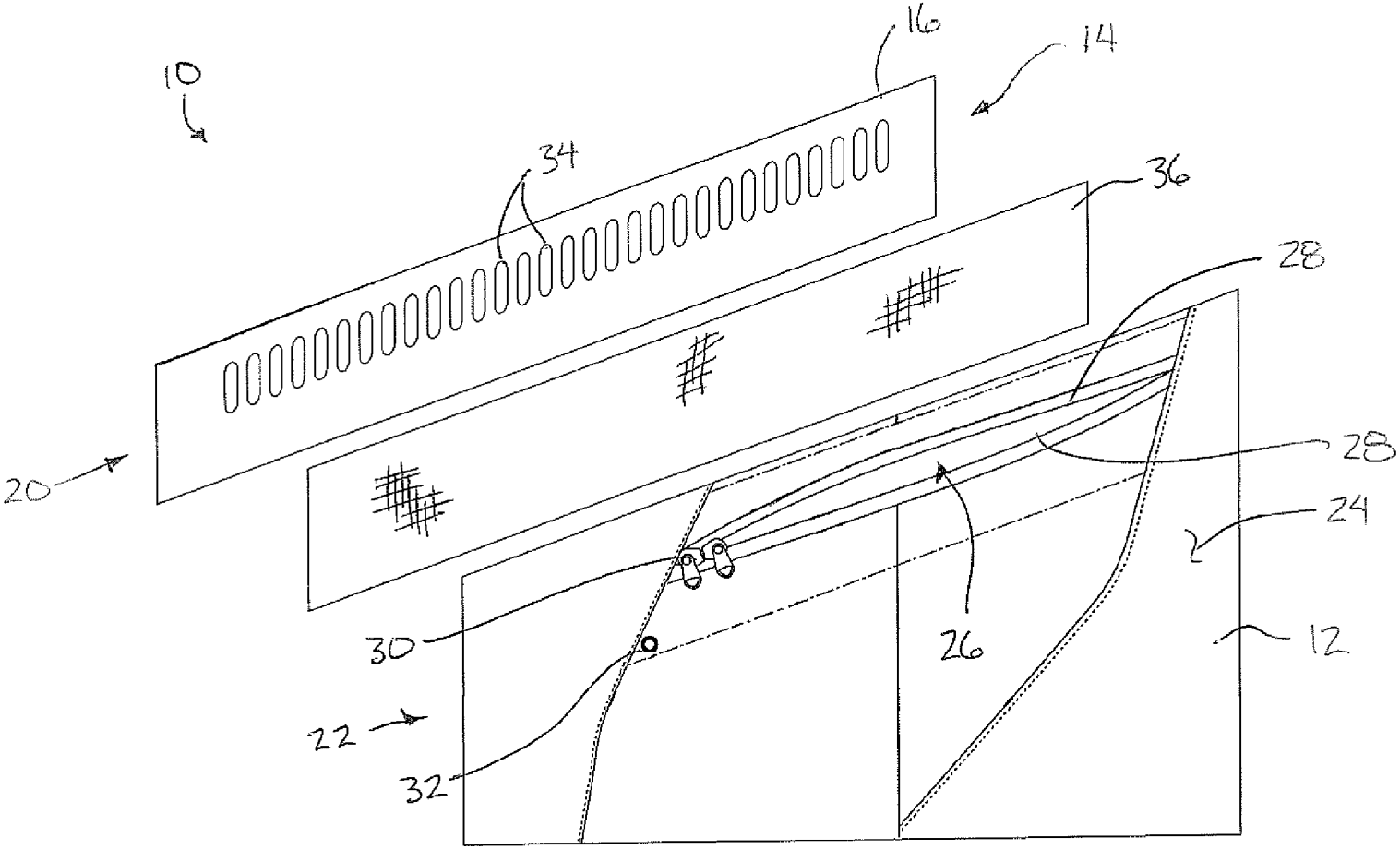
FIG. 1 is an exploded perspective view of a first embodiment of the ventilated garment.

Referring to the accompanying figures there is illustrated a ventilated garment generally indicated by reference numeral 10. The garment 10 may comprise a jacket, pants or a bib pant which are typically worn as active outerwear by snowmobile and motorcycle operators and ski, snowboard and outdoor enthusiasts for example. The garment is well suited to protecting the user from various precipitations including rain or snow while providing adequate ventilation.

Various embodiments are disclosed in the accompanying drawings and description below; however, the common features of the various embodiments will first be described.

The garment 10 generally comprises a shell 12 which is arranged to be worn about the body of the user and which defines the general shape of the garment. In the instance of a jacket, the shell 12 typically comprises a torso portion and arms for being worn about the corresponding torso and arms of the user. Alternatively, when the garment comprises pants, the shell typically comprises two leg portions for being worn about the legs of the user.

The shell 12 includes one or more ventilated portions formed therein in which each ventilated portion is defined by an auxiliary layer 14 comprising a panel of material having a peripheral edge 16 fastened about the periphery of the ventilated portion defined in the shell. The panels forming the ventilated portion of the shell and the auxiliary layer 14 are mounted parallel and alongside one another across the full height and width of the layers.

As shown in FIGS. 1 through 5, the auxiliary layer 14 is mounted adjacent and alongside the inner surface 18 of the shell such that the auxiliary layer defines an innermost layer 20 while the ventilated portion of the shell defines an outermost layer 22. A ventilated area is defined between the innermost layer 20 and the outermost layer 22. The ventilated area is understood to comprise herein an area or opening that can facilitate air exchange into and out of the garment.

Figure 6:
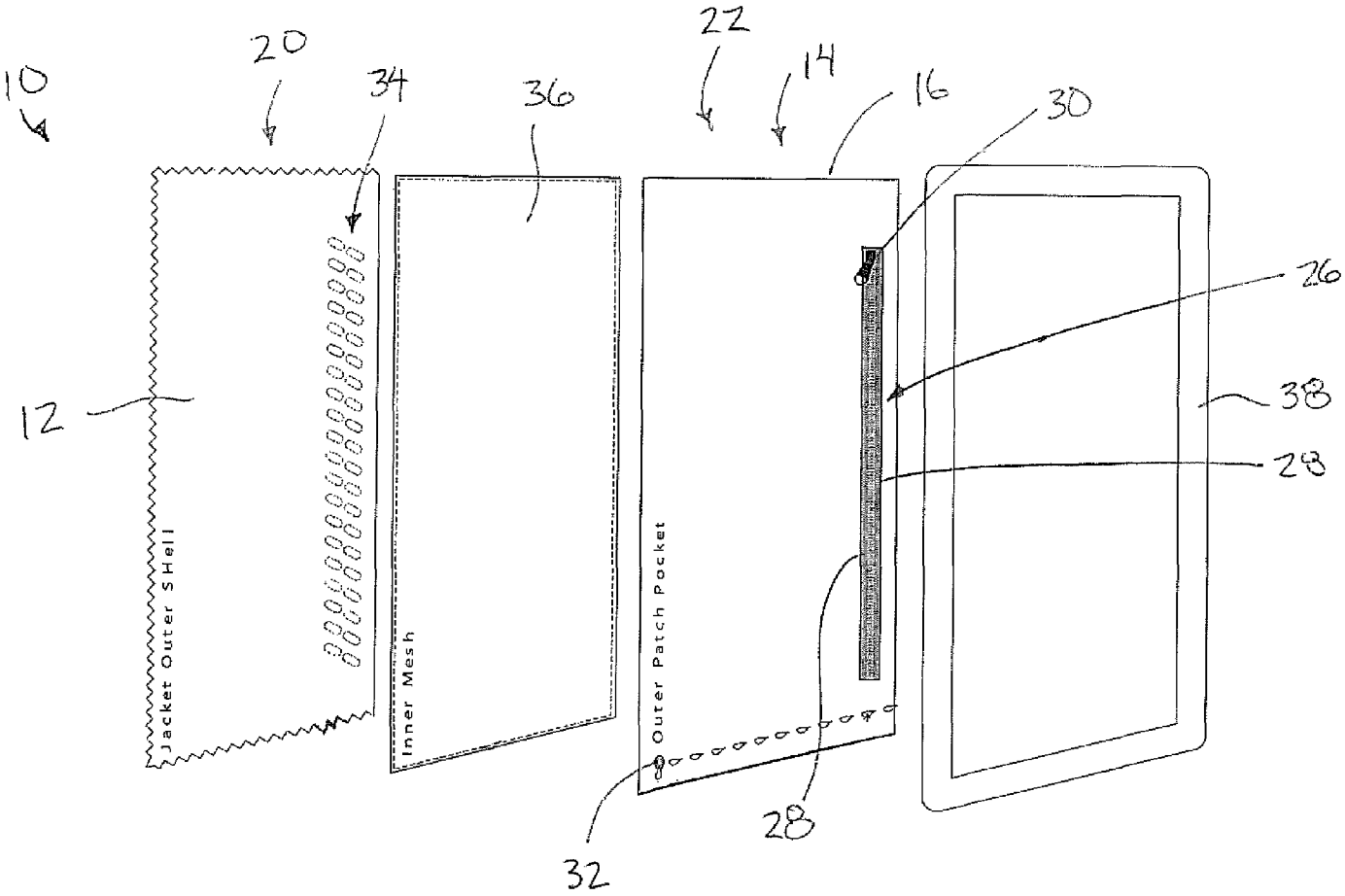
FIG. 6 is an exploded perspective view of a third embodiment of the ventilated garment.

According to FIG. 6, the auxiliary layer may alternatively be mounted to span along the outer surface 24 of the shell. In this instance the auxiliary layer comprises the outermost layer 22 while the ventilated portion of the shell defines the innermost layer, in which the innermost and outermost layers again define the ventilated area therebetween.

In each instance the outermost layer 22 locates an exterior opening 26 therein. The exterior opening comprises an elongate slot extending in a longitudinal direction in the surrounding panel forming the outermost layer. A pair of opposed longitudinally extending edges 28 of the slot are flexible so as to be moveable between an open position in which the edges are spaced apart from one another to define the opening therebetween which is substantially unobstructed and a closed position in which the opposed edges 28 are joined with one another to close the exterior opening 26.

A suitable fastener 30 is mounted on the outermost layer for operating the exterior opening between the open and closed positions thereof. In the illustrated embodiment the fastener 30 comprises a zipper in which a first element of the zipper spans along one of the edges 28 while a second element of the zipper spans along the opposing edge 28. The elements of the zipper are selectively coupled to one another so as to be operable between an open condition of the fastener in the open position of the exterior opening and a closed condition of the fastener in the closed position of the exterior opening.

A drain opening 32 is provided in the outermost layer which is defined by a grommet comprising a reinforced eyelet secured about a hole punched into the panel of the outermost layer in the illustrated embodiment. Alternatively, the punched opening may comprise a stitched eyelet about the opening. In either instance, the reinforcing about the opening maintains the drain opening 32 in a fully open position in communication with the ventilated space between the shell and the auxiliary layer. The auxiliary layer and the shell are joined by an overlapping seam about the full perimeter of the auxiliary layer such that the innermost and outermost layers are sealed relative to one another about the full perimeter of the ventilated space defined therebetween.

The drain opening 32 is located adjacent the bottom end of the peripheral seam of the auxiliary layer joined to the shell. The bottom end of the seam which spans the full width of the ventilated area defined by the auxiliary layer is arranged to be sloped downwardly from one upright side edge of the auxiliary layer to the opposing upright side edge of the auxiliary layer. The downward sloping bottom end of the seam connecting the auxiliary layer to the shell thus defines a lowermost portion of the ventilated area adjacent one side. The drain opening is located adjacent to the lowermost portion at one side of the auxiliary layer. Accordingly, the bottom end of the ventilated area defined by the lower peripheral edge of the auxiliary layer slopes downwardly towards the drain opening.

The innermost layer comprises a panel locating a plurality of ventilated apertures 34 therein which are formed in a repeating grid pattern spanning across the ventilated area. In the illustrated embodiment, each of the ventilating openings 34 are substantially identical in size and spaced apart by an even spacing near to the dimension of the openings; however, the size and spacing of the openings may vary in further embodiments. All of the openings are provided in rows shown to be offset to one edge of the auxiliary layer so as to occupy a minimal area of the overall auxiliary layer; however, in further embodiments, the openings may be centrally located in the auxiliary layer. In particular, the overall combined area of the openings is arranged to be much less than the total area of the panel such that the majority of the panel forming the innermost layer comprises a moisture proof material.

Each of the ventilating openings 34 comprises a punched hole formed in the panel of material forming the innermost layer such that the remainder of the panel surrounding each opening provides support to the opening to maintain the opening in a fully opened condition at all times.

A mesh layer 36 is supported between the innermost and outermost layers such that the single panel forming the mesh layers spans all of the plurality of ventilating openings and such that ventilation air must pass through the mesh layer 36 from the exterior opening to the ventilation openings. The mesh layer 36 is only secured about its peripheral edge to one of the innermost or outermost layers of the ventilated area.

The mesh layer 36 comprises a mesh material having a mesh opening size which is sufficiently small to block the passage of snowflakes therethrough. In some embodiments, a hydrophobic coating is provided on the mesh material or in other embodiments, the mesh material may be made of a hydrophobic yarn to further resist the penetration of water or snow through the mesh layer while also providing some resistance to moisture wicking through the mesh layer. In this manner, the mesh layer defines a moisture repelling membrane allow air passage therethrough. This membrane may comprise a variety of materials both woven and knit goods.

The vent openings are provided in the innermost layer such that the lower edge of the openings are arranged to remain spaced above the lowermost periphery of the auxiliary layer joined to the shell as well as being spaced above the lowermost portion of the mesh layer 36 noted above. Accordingly, when snow enters through the exterior opening and melts in contact with the mesh layer 36, the snow is trapped by the mesh and drips downwardly to a lowermost portion of the mesh which is below the ventilation openings. The moisture is thus led downwardly by gravity to a trough formed between the innermost and outermost layers below the ventilation openings and the exterior opening having a sloped bottom edge directed towards the drain opening for external draining. In the meantime, ventilation air continues to pass through the mesh layer above the moisture trapped in the lowermost portion of the mesh layer so that the ventilation air can reach readily from the exterior opening to the ventilating openings for ventilating the wearer.

To provide a better seal at the fastening of the peripheral edge of the auxiliary layer to the shell, a sealing tape member 38 formed of sealing material overlaps the peripheral edge of the auxiliary layer about the full perimeter. The tape member 38 is arranged for sealing engagement with both the auxiliary layer and the shell with which it is joined by applying the tape with a seam sealing machine that uses heat and pressure to bond the tape to the fabric of the different layers. Moisture channelled through the trough formed between the innermost and outermost layers is thus prevented from penetrating the seam along the lowermost edge to ensure the moisture is channelled only to the drain opening at the lowermost portion of the ventilated area offset to one side thereof.

Figure 3:
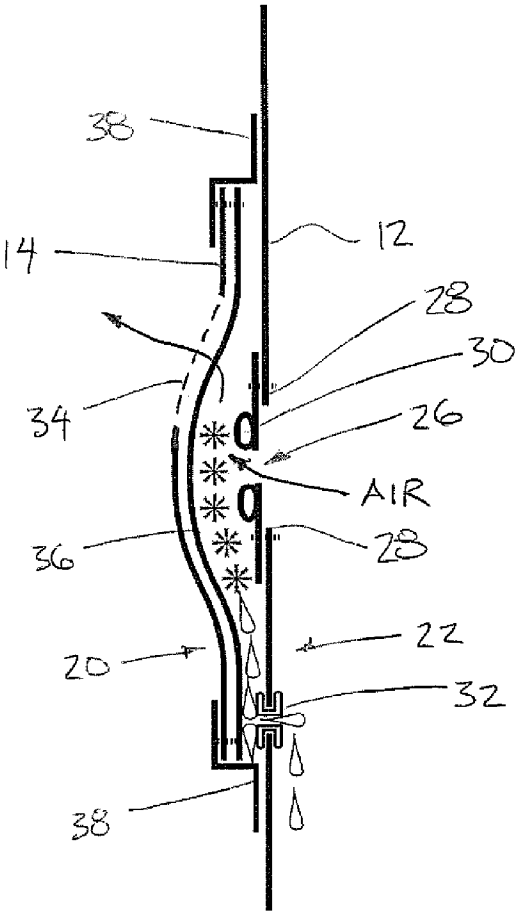
FIG. 3 is a schematic illustration representing a draining function of the first embodiment of the ventilated garment.
Figure 2:
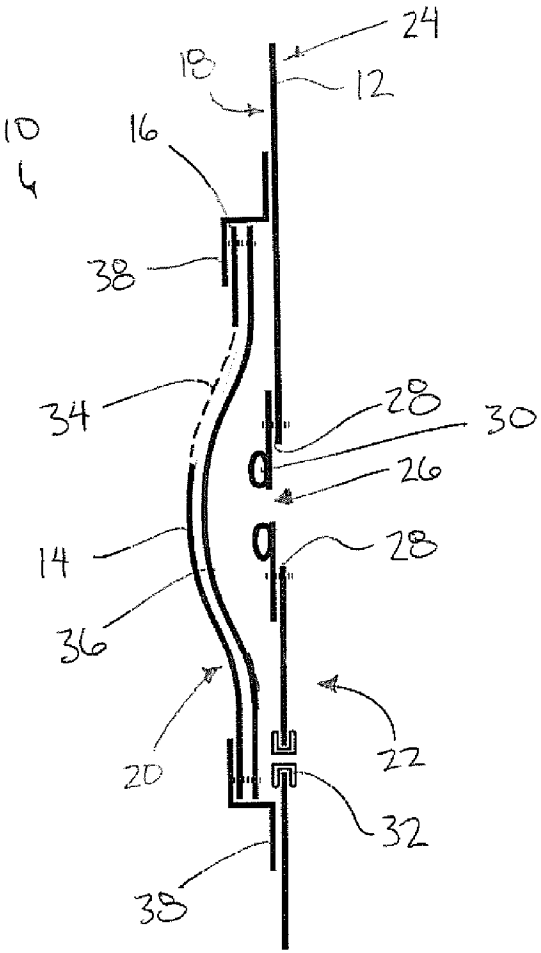
FIG. 2 is a sectional view of the ventilated portion of the shell of the garment according to the first embodiment.

Turning now more particularly to the embodiment of FIGS. 1 through 3, the ventilated portion of the shell in this instance comprises the outermost layer of the ventilated area by supporting the auxiliary layer to span the inner surface of the shell. Also in this instance, the mesh layer is shown to fully span across the ventilated area by spanning the full width and height of the auxiliary layer and by being joined about the peripheral edge thereof to the peripheral edge of the auxiliary layer about the full perimeter of the ventilated area. The mesh layer thus remains parallel to the innermost and outermost layers across the full width and height thereof. The drain opening in this instance communicates with the space enclosed between the outer side of the mesh layer and the outermost layer so that moisture is substantially contained on the outer side of the mesh layer in direct communication with the drain and exterior openings.

Also shown in the embodiment in the embodiment of FIGS. 1 through 3, the ventilation openings are located in the innermost layer so as to be offset upwardly and spaced above the exterior opening such that there is no overlap between the ventilating openings and the exterior opening. The longitudinal direction of the exterior opening slot is nearer to horizontal than vertical in orientation with the top and bottom edges of the auxiliary layer joined to the shell being substantially parallel to the longitudinal direction of the exterior opening slot. The peripheral edges of the exterior opening are also sloped downwardly towards the drain opening.

Figure 8:
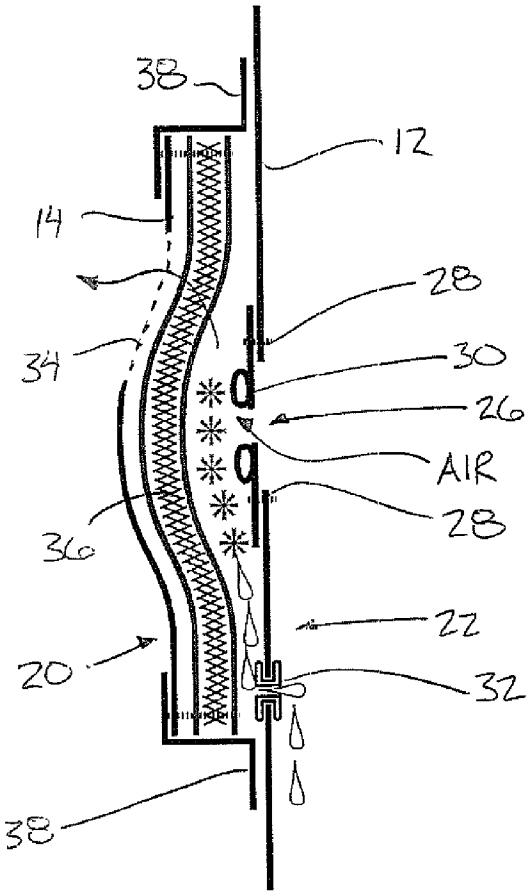
FIG. 8 is a schematic illustration representing a draining function of the fourth embodiment of the ventilated garment.
Figure 7:
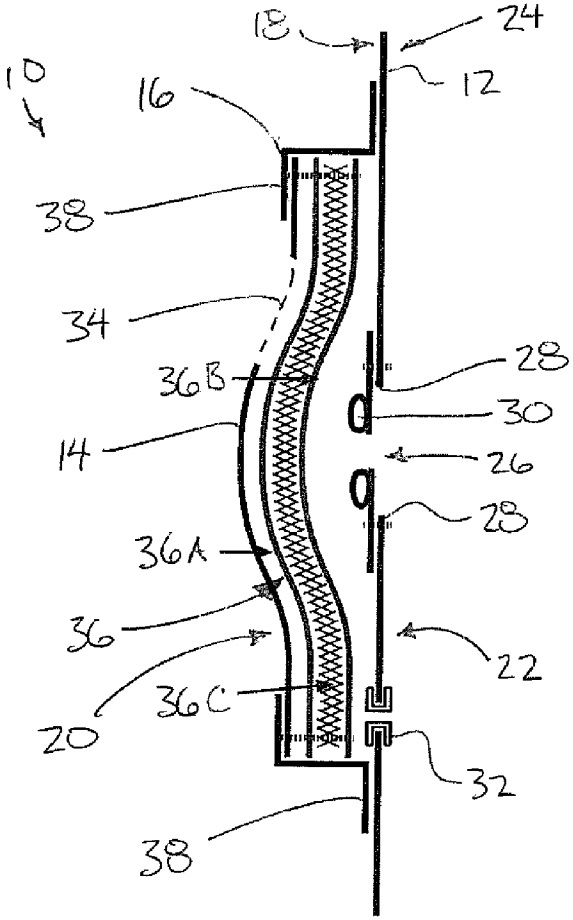
FIG. 7 is a sectional view of the ventilated portion of the shell of the garment according to a fourth embodiment.

Turning now to the embodiment of FIGS. 7 and 8, the inner and outer layers of the ventilated portion are substantially identical to the embodiment of FIGS. 1 through 3; however, the mesh layer 36 in this instance comprises a composite mesh layer. The composite mesh comprises a composite of various types of fibrous material including hydrophobic material either as a coating or as hydrophobic yarns which are assembled into a thickness comprising a plurality of layers of the fibrous material woven or matted together. More particularly, the composite mesh layers comprises several different hydrophobic or non hydrophobic fiber fill, matting or other components that will yield a significantly increased resistance to moisture wicking through the composite mesh and or material layer. In a preferred arrangement, the composite mesh layer 36 comprises an inner layer 36A and an outer layer 36B, each comprising a woven layer of hydrophobic yarn or other material with a hydrophobic coating. The space between the inner layer 36A and the outer layer 3613 are filled with an intermediate layer 36C comprising hydrophobic fiber fill or fiber matting to provide increased resistance to moisture penetration for extreme applications while still allowing air to freely ventilate through the gusset system.

In yet further embodiments, this composite material may eliminate the innermost layer so that the ventilated area or ventilated portion of the garment is simply defined between the outer layer and the composite mesh layer.

Figure 5:
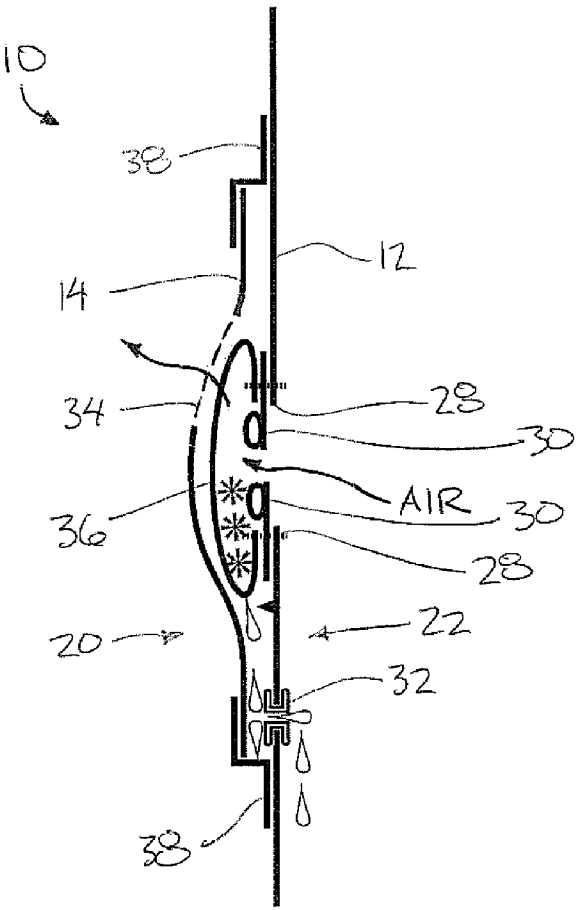
FIG. 5 is a schematic illustration representing a draining function of the second embodiment of the ventilated garment.
Figure 4:
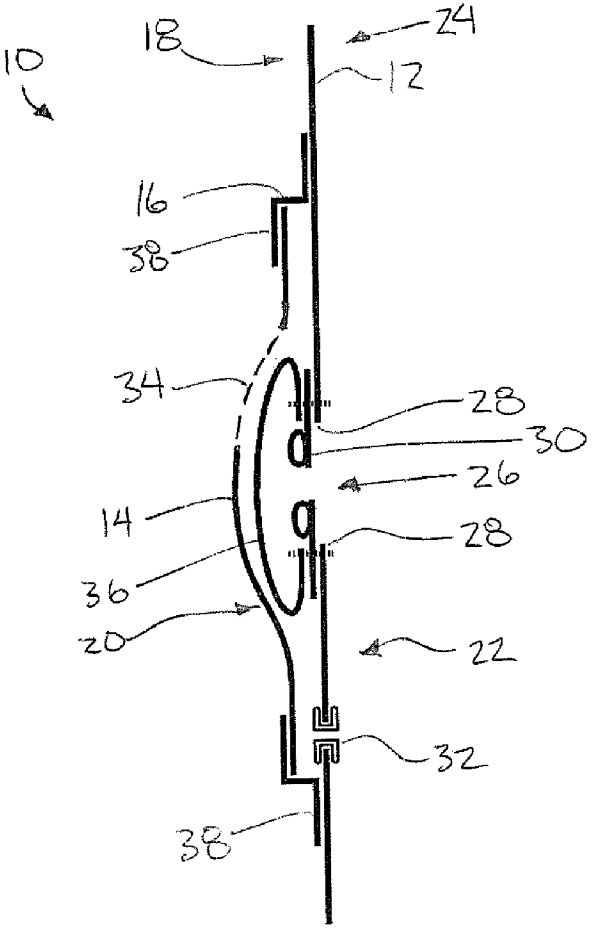
FIG. 4 is a sectional view of the ventilated portion of the shell of the garment according to a second embodiment.

Turning now to the embodiment of FIGS. 4 and 5, the mesh layer in this instance is shown secured about its periphery to the peripheral edge about the exterior opening of the outermost layer. As shown in the accompanying figures, the mesh panel forming the mesh layer spans an area which is greater than the area of the exterior opening in the fully open position such that a portion of the mesh may hang below the lowermost peripheral edge of the exterior opening for forming a lower trough portion within which precipitation can collect. Rain or melting snow is thus channelled to the lowermost portion of the mesh layer which is spaced below the ventilating openings so that the moisture dripping through the lower trough portion of the mesh layer is then channelled by the trough defined by the innermost and outermost layers of the ventilated area towards the drain opening. In each of the embodiments of FIGS. 1 through 5, the ventilating air can still readily pass through the ventilated area from the exterior opening upwardly to the ventilating openings thereabove.

Turning now to the embodiment of FIG. 6, the auxiliary layer is instead shown mounted to span the outer surface of the shell such that the auxiliary layer in this instance defines the outermost layer of the ventilated area while the ventilated portion of the shell enclosed by the auxiliary layer forms the innermost layer. The mesh layer in this instance also spans the outer surface of the shell when mounted between the shell and the auxiliary layer as in the previous embodiments. Accordingly the exterior opening is located in the auxiliary layer and the ventilating openings are located in the shell.

In the embodiment of FIG. 6 the bottom edge remains sloped across the full width of the auxiliary layer from the exterior opening which is vertically oriented adjacent one side of the ventilated area and the drain opening at the opposing side adjacent the lowermost portion of the peripheral edge of the auxiliary layer. In this instance the ventilated openings are provided in vertical row in substantial alignment with the exterior opening so that the ventilating openings and exterior opening overlap one another for optimal direct ventilation therebetween through the intermediate mesh layer. The mesh layer in this instance is also secured only at the peripheral edge adjacent the peripheral edge of the auxiliary layer about the full perimeter thereof. Moisture remains trapped between the mesh layer and the outermost layer of the ventilated area for being channelled to the drain opening instead of reaching the ventilating openings. The ventilating openings are sufficiently small in size that the surrounding panel locating the ventilating openings therein substantially prevents contact between the mesh layer and inner clothing layers of the user to prevent moisture wicking from the mesh layer to the inner layers of clothing in use unlike any other prior art ventilated garments.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A ventilated garment comprising:

a shell shaped as an outerwear garment so as to be arranged to be worn about a portion of a body of a user, the shell including a ventilated portion;

an auxiliary layer attached about a periphery thereof to a periphery of the ventilated portion of the shell so as to define a ventilated area between an outermost layer comprising one of the auxiliary layer and the ventilated portion of the shell and an innermost layer comprising another one of the auxiliary layer and the ventilated portion of the shell;

an exterior opening formed in the outermost layer of the ventilated area;

a fastener associated with the exterior opening and being arranged to be operable between an open position in which the exterior opening is substantially unobstructed and a closed position in which the exterior opening is closed;

a drain opening formed in the outermost layer of the ventilated area adjacent a lowermost portion of the periphery of the auxiliary layer;

at least one ventilating opening formed in the innermost layer of the ventilated area such that a lowermost edge of said at least one ventilating opening is spaced above said lowermost portion of the periphery of the auxiliary layer; and a mesh layer supported between the ventilated portion of the shell and the auxiliary layer such that ventilating air can only reach said at least one ventilating opening from the exterior opening by passing through the mesh layer.

2. The ventilated garment according to claim 1 wherein a bottom end of the periphery of the auxiliary layer is sloped downwardly towards the drain opening.

3. The ventilated garment according to claim 1 wherein the drain opening comprises a punched opening in the outermost layer of the ventilated area including reinforcing about the opening arranged to maintain the opening in an open position.

4. The ventilated garment according to claim 1 wherein said at least one ventilating opening comprises a plurality of openings at spaced apart positions in the innermost layer of the ventilated area.

5. The ventilated garment according to claim 1 wherein said at least one ventilating opening is substantially aligned with the exterior opening such that said at least one ventilating opening and the exterior opening overlap one another.

6. The ventilated garment according to claim 1 wherein said at least one ventilating opening is offset from the exterior opening such that said at least one ventilating opening and the exterior opening do not overlap one another.

7. The ventilated garment according to claim 1 wherein said at least one ventilating opening is above the exterior opening such that said at least one ventilating opening and the exterior opening do not overlap one another.

8. The ventilated garment according to claim 1 wherein said at least one ventilating opening formed in the innermost layer of the ventilated area comprises a punched opening and wherein a material of the innermost layer which surrounds said at least one ventilating opening supports said at least one ventilating opening to remain in a fully open condition.

9. The ventilated garment according to claim 1 wherein said at least one ventilating opening is spaced above a lowermost portion of the mesh layer.

10. The ventilated garment according to claim 1 wherein said at least one ventilating opening occupies less than half of a total area of the innermost layer of the ventilated area.

11. The ventilated garment according to claim 1 wherein said at least one ventilating opening comprises a plurality of openings at spaced apart positions from one another and wherein the mesh layer comprises a single mesh panel spanning the plurality of openings which is only secured about a peripheral edge of the mesh layer relative to the shell and the auxiliary layer.

12. The ventilated garment according to claim 1 wherein the mesh layer comprises a mesh material having mesh openings which are sized to prevent passage of snowflakes therethrough.

13. The ventilated garment according to claim 1 wherein the mesh layer is formed with hydrophobic material.

14. The ventilated garment according to claim 1 wherein the mesh layer is formed of a composite of fibrous material including hydrophobic components so as to resist moisture wicking therethrough, the mesh layer having a thickness corresponding to a plurality of layers of the fibrous material.

15. The ventilated garment according to claim 1 wherein a peripheral edge of the mesh layer is secured to the shell adjacent to the periphery of the auxiliary layer.

16. The ventilated garment according to claim 1 wherein a peripheral edge of the mesh layer is secured about a periphery of the exterior opening.

17. The ventilated garment according to claim 16 wherein the mesh layer comprises a mesh panel spanning an area which is greater than an area of the exterior opening in the open position such that a portion of the mesh panel is suspended below a lowermost peripheral edge of the exterior opening.

18. The ventilated garment according to claim 1 wherein the auxiliary layer is attached to an inner surface of the shell such that the outermost layer comprises the ventilated portion of the shell, the exterior opening and the drain opening are located in the ventilated portion of the shell, the innermost layer comprises the auxiliary layer, and said at least one ventilating opening is located in the auxiliary layer.

19. The ventilated garment according to claim 1 wherein the auxiliary layer is attached to an outer surface of the shell such that the outermost layer comprises the auxiliary layer, the exterior opening and the drawing opening are located in the auxiliary layer, the innermost layer comprises the ventilated portion of the shell, and said at least one ventilating opening is located in the ventilated portion of the shell.

20. The ventilated garment according to claim 1 wherein there is provided a strip of sealing material overlapping the periphery of the auxiliary layer so as to be in sealing engagement with both the shell and the auxiliary layer about a full perimeter of the auxiliary layer.

* * * * *